United States Patent [19]

Vogt

[11] Patent Number: 5,000,418

[45] Date of Patent: Mar. 19, 1991

[54] DEVICE FOR TEMPORARILY FIXING A STICK TO A SUPPORT

[76] Inventor: Walter Vogt, 47 Avide Vaudagne, 1217 Meyrin, Switzerland

[21] Appl. No.: 396,648

[22] Filed: Aug. 22, 1989

[30] Foreign Application Priority Data

Aug. 31, 1988 [FR] France ..... 88 11569

[51] Int. Cl.[5] ..... A47G 29/00

[52] U.S. Cl. ..... 248/689; 248/205.1; 248/914

[58] Field of Search ..... 248/689, 155, 685, 229, 248/914, 205.1, 231.5, 295.1, 125

[56] References Cited

U.S. PATENT DOCUMENTS

| | | | |
|---|---|---|---|
| 2,516,760 | 7/1950 | Doran | 248/914 X |
| 2,854,147 | 9/1958 | Derr | 248/295.1 X |
| 3,146,986 | 9/1964 | Gorth | 248/689 X |
| 3,329,041 | 7/1967 | Moss | 248/125 X |
| 3,860,210 | 1/1975 | Berardinelli | 248/205.1 X |
| 4,118,001 | 10/1978 | Serkez | 248/914 X |
| 4,300,742 | 11/1981 | Hunn | 248/689 |
| 4,842,231 | 6/1989 | Warshawsky | 248/295.1 X |

FOREIGN PATENT DOCUMENTS

| | | |
|---|---|---|
| 90830 | 1/1896 | Fed. Rep. of Germany . |
| 349689 | 3/1922 | Fed. Rep. of Germany . |
| 2140450 | 3/1973 | Fed. Rep. of Germany . |
| 561390 | 10/1923 | France . |
| 603986 | 4/1926 | France . |
| 463701 | 4/1937 | United Kingdom ..... 248/689 |

*Primary Examiner*—J. Franklin Foss

*Attorney, Agent, or Firm*—Young & Thompson

[57] ABSTRACT

The device (1) comprises two arms (5, 6) which are superimposed and hinged to a body (4) in order to be able to clamp the support. The lower arm (6) is provided with a spring (7). When not in use, the two arms are folded against the body. The back of the body comprises a pair of opposed wings (11, 12) maintaining it by clipping onto the stick (3).

13 Claims, 1 Drawing Sheet

DEVICE FOR TEMPORARILY FIXING A STICK TO A SUPPORT

The present invention relates to a device for temporarily fixing a stick to a support, particularly when it is not used.

Persons who cannot walk without a stock nearly always have problems keeping their stock within reach when they do not use them, in order to be able to take them again afterwards. This situation arises particularly when the stick user is seated, or when he is in upright position and wants to temporarily leave a stick to have a free hand. It is often difficult for him to find in its vicinity an adequate support for the type of stick he uses, so that it often falls or handicaps the user which has to keep it against him. This is particularly the case with sticks extending under the forearm, the so called english sticks, which are cumbersome and difficult to hook at a support of any kind since they do not have a hooked grip. To solve this problem, it has been proposed to equip a stick with a retractable feet device, enabling to the stick to remain standing without holding it. However, the ground has to be horizontal and the stick can nevertheless easily fall if it is touched. Furthermore, such a device represents a weight at the end of the stick and it is costly. This is why the present invention tends to solve the problem in a different way, by means of a simple and light device enabling the user to temporarily fix his stick to any element able to serve as support and located near him, for example the edge of a table, a chair rod, a hand rail, a caddie and so on. A side aim is to obtain a device which the user can easily install himself on a standard stick he owns.

There is also known from patent No. DE-90.830 a fixing device for a stick or an umbrella which is integrated in the handle or upper position of it. This device comprises a body riveted onto the top of the stick, presenting a hollow cylinder housing a screw. Two hingable jaws are pivoted onto the body, the one being fast with a nut meshing with the screw. This system is complicated and not removable, it has to be foreseen at the manufacture of the stick. Furthermore, nothing permits to adjust the position of the device with respect to the stick.

There is further known from patent No. FR-561.340 a stick-carrier comprising a pliers fastened onto the stick by wedging, which is fastened with a U shaped claw. A blade spring is fastened to one of the sides of the claw and extends towards the other side of it. Such a device is not stable, it is cumbersome, the claw being not foldable when not in use, and the pliers can damage the surface of the stick or on the contrary be too loose to fit onto the stick.

The present invention has for its aim a fixing device for a stick obviating to the precited drawbacks.

The present invention has for its object a device for temporarily fixing a stick to a support, particularly when it is not in use, comprising an elongated body (4) provided with a first arm (5) mounted by a hinge onto the body in the vicinity of one end of it and adapted to occupy a service position in which it presents on one of its side a first clamping face (31) extending in a direction transverse to the stick, and with a second arm (6) mounted by a hinge onto the body (4) near its other end and having a second clamping face (30) characterized by the fact that the body is slidingly mounted on a portion of the stick, and by the fact that a spring (7) tends to pivot the second arm around its hinge towards (A) the first arm to clamp the said support between the two clamping surfaces The invention and its advantages will be apparent from the description of a realization of the device given as a non limitative example in reference to the attached drawings in which:

Figure 1:
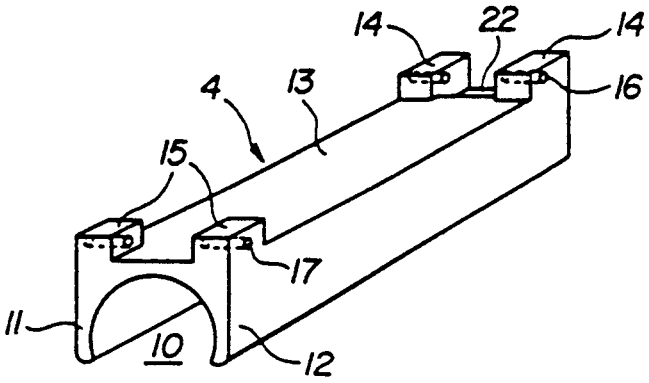
FIGS. 1 to 4 represent separately four constitutive elements of the device.
Figure 2:
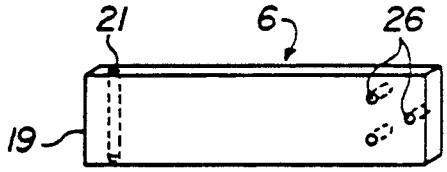
Figure 3:
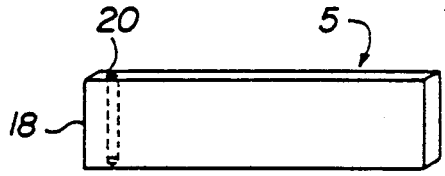
Figure 4:
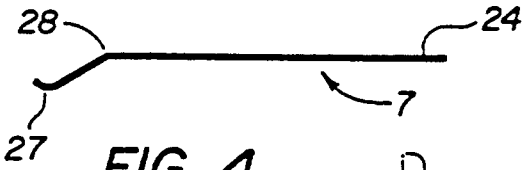
Figure 5:
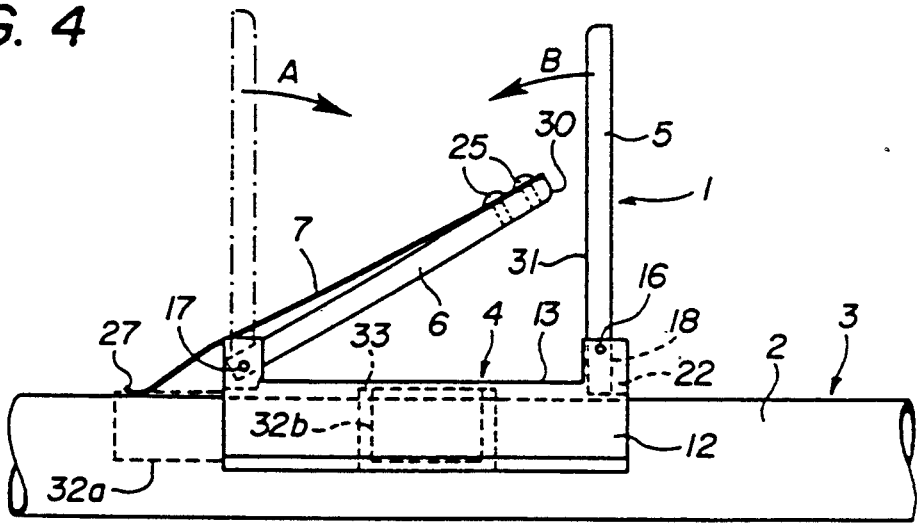
FIG. 5 is a lateral view of a device mounted on a stick.

The device 1 shown at FIG. 5 is designed to be fixed laterally by clipping on a cylindrical rectilinear portion 2 of a stick. It comprises four main elements represented by FIGS. 1 to 4, i.e. a body 4 designed to be fixed to the stick, an upper arm 5 and a lower arm 6 both carried by said body, and a spring 7 associated with the lower arm 6. The elements 4, 5 and 6 are preferably moulded parts in rigid synthetic material, such as PVC, but they can be made in any other adapted materials, particularly in a light alloy. The body 4 has the shape of an elongated bloc crossed by a central longitudinal void 10 substantially cylindrical and opened on whole its length, between two lateral wings 11, 12 which can be resilient or not, designed to squeeze the stick 3 due to the transverse elasticity of the body 4 (clipping) when the stick is entered into the void 10. This body slides with gentle friction along the stick, it may also in a variant slide freely along the stick. On the other side, the body has a front face 13 having near its corners two pairs of merging lugs 14, 15 each pierced by a transverse hole 16, 17 to respectively carry in a hinged manner the arms 5 and 6. In this example, each arm 5, 6 has the shape of a simple bar and its rear end 18, 19 is provided with a transverse through hole 20, 21 to be mounted in a hinged manner in the middle of the corresponding pair of lugs 14, 15 by means of a respective pin driven in the holes 16, 17. The holes 16 are more distant from the face 13 of the body than the holes 17, of a value slightly greater than the thickness of the lower arm 6. Thus one can fold (arrow A) the lower arm 6 parallely to the stick against the face 13, then fold also the upper arm 5 on top of the arm 6 (arrow B) to reduce the encumbrance of the device when it is not in use. In its service position shown at FIG. 5, the upper arm 5 is maintained perpendicularly to the face 13 and thus to the stick, since its rear end 18 abuts laterally into a notch 22 (FIG. 1) provided between the lugs 14. The hinge of arm 5 can have friction so as to enable the arm to be kept in any position at rest.

The spring 7 has a plan portion extending along the lower face of the arm 6, i.e. on the opposite side of arm 5, and a fore end 24 fastened to the arm by means of screws 25 located in holes 26 of the arm. At the other end, the spring extends beyond the hinge of the arm and is provided with a rounded end 27 which comes behind a curve 28 so as to be permanently applied against the stick 3, tending to pivot the arm 6 in the direction of the arrow A, towards the arm 5 and the face 13 of the body. Of course one could obtain the same effect by means of an other spring, such that a coil spring mounted in the hinge of the arm 6. The arm 6 has a length slightly less than the maximal distance between the two arms, so that its fore end 30 is quite near the opposite face 31 of the arm 5 when it comes against the face 13 of the body.

Thus any object or support placed between the two arms 5 and 6 will be tightened between them, more preciselY between the surfaces 30 and 31, through the force of the spring 7.

Figure 7:
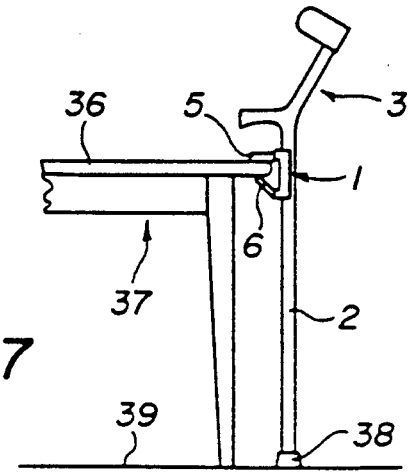
FIG. 7 shows a british stick equipped with the device.

When the user uses the stick 3 for walking and has then no need of the device 1, he may fold the upper arm 5 against the lower arm 6 which is folded by the spring. When the user wants to fix the stick to a support, as for example shown at FIG. 7, i.e. on the edge of the top 36 of a table 37, he may adjust the device 1 at the height of the top by sliding it along the cylindrical portion 2 of the stick. Thereafter, he unfolds the arm 5, then the arm 6 which is thereafter released to clamp the support. Generally the foot 38 of the stick 3 rests on the ground 39 and supports the whole weight of the stick. The user can remove its stick from the support by simply pulling it backwardly, and then use it immediately even without folding the arm 5. It is to be noted that the device can clamp practically any supporting element the width of which is not greater than the distance separating the two arms, whatever the shape of this element is such as a bar, a flat part, a hook and so on.

Figure 6:
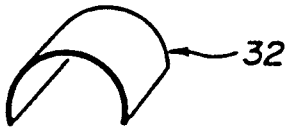
FIG. 6 is a perspective view of an accessory element of the device.

FIGS. 5 and 6 show also a further element which can complete the above described device 1, to ensure that the body 4 will not slide unwillingly along the portion 2 of the stick 3. This element is an abutment ring 32 made of steel, opened laterally and designed to be placed over the cylindrical portion 2 of the stick and clamping it strongly through its elasticity, so that a transverse surface of the body will abut against the ring 32 if it has the tendency to slide. The ring 32 could be placed for example below the lower end of the body, in a position 32*a* located in front of the rounded end 27 of the spring, to avoid the progressive sliding of the device down to the foot 38 of the stick under the effect of shocks during the walk. In an other realization, it can be located in a position 32*b* between the stick and the central portion of the body 4, this latter having in its cylindrical void 10 a central recess 33 the sides of which form shoulders which can abut against the ring 32. In this way, the ring 32 maintained through friction along the stick, avoids an unwanted displacement of the body 4, but one still can adjust the position of the device by pulling it strongly enough to overcome the friction of the ring onto the stick. Furthermore, the device 1 can easily be taken away from the stick and put later on in place again, the ring 32 remaining on the stick without any inconvenience. If necessary, the ring can be screwed onto the stick.

It is evident that this simple device can be manufactured at low costs and put in place by its owner without difficulties and without necessitating a tool. It is intended to be placed in the upper portion of the stick, so as not to increase the weight of the foot of the stick and to be located near the hand which holds the stick. Finally, everybody can install the device at the height which is convenient for him.

Many other embodiments of the invention are possible. In place of the resilient wings 11 and 12, the body 4 may be rigid and surrounded more completely, i.e. over 180°, the cylindrical portion 2 of the stick, by being slid over it, from the foot, at the manufacture of the stick. Besides, the upper arm can be fixed and be an integral part of the body. Another possible variant consists of subdividing the body into two elements connected by means of a pivot perpendicular to the stick, one of these elements being fixed to the stick and the other carrying the arms, so that the clamping direction be not necessarily parallel to the arm of the stick; this would enable for example to orient the clamp formed by the arms in order to fix easily the stick in an oblique position or to fix it to a vertical support such as the back of a chair.

In an other variant, the arms can have holding means, in form of ears for example, to facilitate their opening.

The spring can be a coil spring having a central flat portion bearing against the second arm, and two end portions formed by coils ended by a rectilinear portion driven into holes of the body.

The active faces of the arms, facing one another, in service position, can be provided with a non slipping covering.

The first arm 5 can be hinged onto the body with a smooth or hard friction force. One can thus by unfolding partially the said arm form a kind of hook by means of which the stick can be suspended to any tubular member or hook without the use of the other arm 6. One can also provide for a locking system permitting to maintain the arm in two or more different service positions with respect to the body.

I claim:

1. Device for temporarily fixing a stock to a support, particularly when it is not in use, comprising an elongated body (4) provided with a first arm (5) pivotably mounted by a fixed hinge onto the body in the vicinity of one end of it and adapted to occupy a service position in which it presents on one of its sides a first clamping face (31) extending in a direction transverse to the stock, and with a second arm (6) pivotably mounted by a fixed hinge onto the body (4) near its other end and having a second clamping face (30), wherein the body is slidably mounted on a portion of the stick and a spring (7) urges the second arm around its hinge towards (A) the first arm to clamp the said support between the two clamping surfaces; said body (4) having a portion extending between said fixed hinges and parallel to the stock, wherein said first arm (5) is pivotable about a first axis located farther from said portion than a second axis about which said second arm (6) is pivotable, whereby said first arm (5) can be folded to overlie said second arm (6) when said device is not in use.

2. Device according to claim 1, wherein the second arm (6) has a length less than the maximum distance separating the two arms, so that it can be folded by the action of said spring (7) to a position substantially parallel to the stick when there is no support between the arms.

3. Device according to claim 2, wherein the first arm (5), hinged to the body, is foldable in a direction (B) towards the second arm, until a position substantially parallel to the stick in the absence of a support between the two arms.

4. Device according to claim 1, wherein the body comprises at least one pair of opposed wings (11, 12) surrounding a cylindrical portion of the stick over more than 180°.

5. Device according to claim 4, wherein the body (4) is formed of an elongated bloc of synthetic material comprising a longitudinal substantially cylindrical void (10) laterally opened between said two wings (11, 12) on the opposite side of the arms, said wings being resilient.

6. Device according to claim 1, further comprising at least one abutment ring (32), fast to the stick, and cooperating with at least one transverse surface of the body (4) to limit its axial stroke along the stick.

7. Device as claimed in claim 6, wherein the ring (32) is a steel ring, laterally opened and clamped on the stick through its own elasticity.

8. Device according to claim 1, wherein the spring (7) is formed by a blade spring located along the second arm (6) and having a free end (27) extending beyond the hinge of the arm to abut laterally against the stick on the body for any position of said arm.

9. Device according to claim 1, wherein the spring is in the form of a wire, its ends being fixed into the body, and comprises a central portion, separated from its ends by at least one coil turn, resting against the second arm and tending to fold it towards the body.

10. Device according to claim 1, wherein an fact that the assembly formed by the two arms and the spring is pivotally mounted onto the body around an axis perpendicular to the longitudinal axis of the body.

11. Device according to claim 1, wherein the first arm can occupy at least two different service positions for which it forms different angles with respect to the body.

12. Device according to claim 1, wherein the first and second arms (5, 6) have a combined length substantially greater than the length of said elongated body (4).

13. Device according to claim 1, further comprising abutment means (22) formed on said elongated body (4) adjacent the fixed hinge of said first arm (5) and limiting the extent of pivotal movement of said first arm (5) away from said elongated body (4) to a position at which said first arm (5) extends substantially perpendicular to said elongated body (4), said first arm (5) being free of spring means bearing thereon.

* * * * *